US005425324A

United States Patent [19]

Cotton

[11] Patent Number: 5,425,324

[45] Date of Patent: Jun. 20, 1995

[54] DEVICE FOR CONNECTING A FLOATING OBJECT TO A MOORAGE STRUCTURE

[75] Inventor: Oren L. Cotton, Eastsound, Wash.

[73] Assignee: DockTender Inc., Eastsound, Wash.

[21] Appl. No.: 315,953

[22] Filed: Sep. 30, 1994

[51] Int. Cl.[6] ..... B63B 21/00

[52] U.S. Cl. ..... 114/230; 405/219

[58] Field of Search ..... 114/230, 219; 405/219; D8/349, 354

[56] References Cited

U.S. PATENT DOCUMENTS

| | | | |
|---|---|---|---|
| 1,094,618 | 4/1914 | Steinhauer | 114/230 |
| 2,679,810 | 6/1954 | Herbert et al. | 114/230 |
| 3,120,831 | 1/1964 | Fulton | 114/230 |
| 3,187,707 | 6/1965 | Carbone | 114/230 |
| 3,195,498 | 7/1965 | Johns | 114/230 |
| 3,196,824 | 7/1965 | Howard | 114/230 |
| 3,389,675 | 6/1968 | Kieft et al. | 114/230 |
| 4,040,377 | 8/1977 | Olsen | 114/230 |
| 4,250,827 | 1/1981 | Booker et al. | 114/230 |
| 4,356,783 | 11/1982 | Myklebust et al. | 114/230 |
| 5,013,272 | 5/1991 | Watkins | 114/219 |
| 5,036,787 | 8/1991 | Rogers | 114/230 |
| 5,154,132 | 10/1992 | Brushaber | 114/230 |

*Primary Examiner*—Jesus D. Sotelo

*Attorney, Agent, or Firm*—Chernoff Vilhauer, et al.

[57] ABSTRACT

A mooring device for connecting a floating object to a moorage structure includes an elongate resiliently yieldable member which has a longitudinally-extending, normally arcuate shape when in an unstressed state. The yieldable member is operatively connected between the floating object at a first end and the moorage structure at a second end. The yieldable member is yieldably bendable from the normally arcuate shape to a more arcuate shape in response to movement of the floating object toward the moorage structure so as to yieldably resist the movement. One exemplary embodiment would include a base which connects the second end to the moorage structure. Another exemplary embodiment would include a removable resilient fender which is adapted to connect the first end to the floating object.

9 Claims, 7 Drawing Sheets

DEVICE FOR CONNECTING A FLOATING OBJECT TO A MOORAGE STRUCTURE

BACKGROUND OF THE INVENTION

The present invention relates to a device for connecting a floating object to a moorage structure and particularly to a fiberglass mooring device for mooring a vessel to a dock, pier, or moorage float.

Floating objects such as boats, vessels, or platforms are traditionally moored alongside moorage structures such as docks, piers, or floats by use of mooring lines and resilient fenders. However, when a floating object is moored to a moorage structure using traditional devices, during severe or stormy conditions the floating object, the moorage structure, or both are generally subject to damage. Fenders placed between the floating object and the moorage structure as a buffer are easily dislodged or otherwise are insufficient to prevent damage. Further, where currents, storm waves, or wakes of passing vessels cause significant or prolonged relative movement, traditional fenders may rub the surfaces of the floating object and cause considerable damage to the paint or other surface finish.

Another problem with traditional devices for attaching floating objects to moorage structures is the necessity to adjust conventional mooring lines in response to tidal rise and fall of the water with respect to the moorage structure. No such adjustment is needed when the moorage structure is a float which is free to rise and fall on the tide. Even with floats, however, it is sometimes difficult to limit movement of a floating object to the extent desired without undesirably straining mooring lines when the floating object moves relative to the moorage structure in response to storm waves or wakes of passing vessels.

Mooring whips are one type of device used to connect a floating object to a moorage structure. These whips consist of a highly flexible straight rod or pole which is securely and permanently fastened to a moorage structure. Whips are an improvement over other devices in that they allow for adjustment in heights due to tides. However, because a mooring whip is essentially straight when it is not connected to the floating object, it must be highly flexible so that it can be bent manually to connect its free end to the floating object. This high degree of flexibility, however, often allows too much movement of the floating object which can then come in contact with the moorage structure and thereby cause damage under severe wave or wake conditions. Another problem with mooring whips is that they are generally permanently installed on moorage structures and are not portable to enable their use in connecting a floating object to alternate moorage structures having no permanently installed mooring whips.

What is needed, then, is a mooring device which, although resiliently yieldable, is much less flexible than a conventional mooring whip and is of simple, inexpensive construction, capable of quiet operation and adaptable to floating objects of differing heights. The mooring device should be usable either in combination with or independent of conventional mooring lines to control movement of a floating object with respect to a moorage structure with sufficient resilient resistance to prevent contact between the moorage structure and the floating object under severe conditions. The mooring device should also be portable and attachable to any moorage structure.

SUMMARY OF THE INVENTION

A mooring device according to the present invention includes an elongate resiliently yieldable member which has a longitudinally-extending, normally arcuate shape when in an unstressed state. The yieldable member is operatively connected between the floating object at a first end and the moorage structure at a second end, and is yieldably bendable from the normally arcuate shape to a more arcuate shape in response to movement of the floating object toward the moorage structure so as to yieldably resist the movement.

A preferred permanent exemplary embodiment would include a base which connects the second end fixedly to the moorage structure and the first end detachably to the floating object. The base may have single or multiple attachment positions to accommodate for varying heights of moorage structures and floating objects.

A preferred portable exemplary embodiment would include a removable resilient fender which is adapted to connect the first end detachably to the floating object and the second end detachably to the moorage structure.

According to one aspect of the invention, a mooring device secures a floating object to a moorage structure.

According to another aspect of the invention, a mooring device prevents damage to both a floating object and a moorage structure while the floating object is secured to the moorage structure.

A further aspect of the invention is that a mooring device may accommodate the height differences between floating objects and moorage structures.

Yet another aspect of the invention is that a mooring device may be easily and removably transported on a floating object to be used in connecting with any moorage structure.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
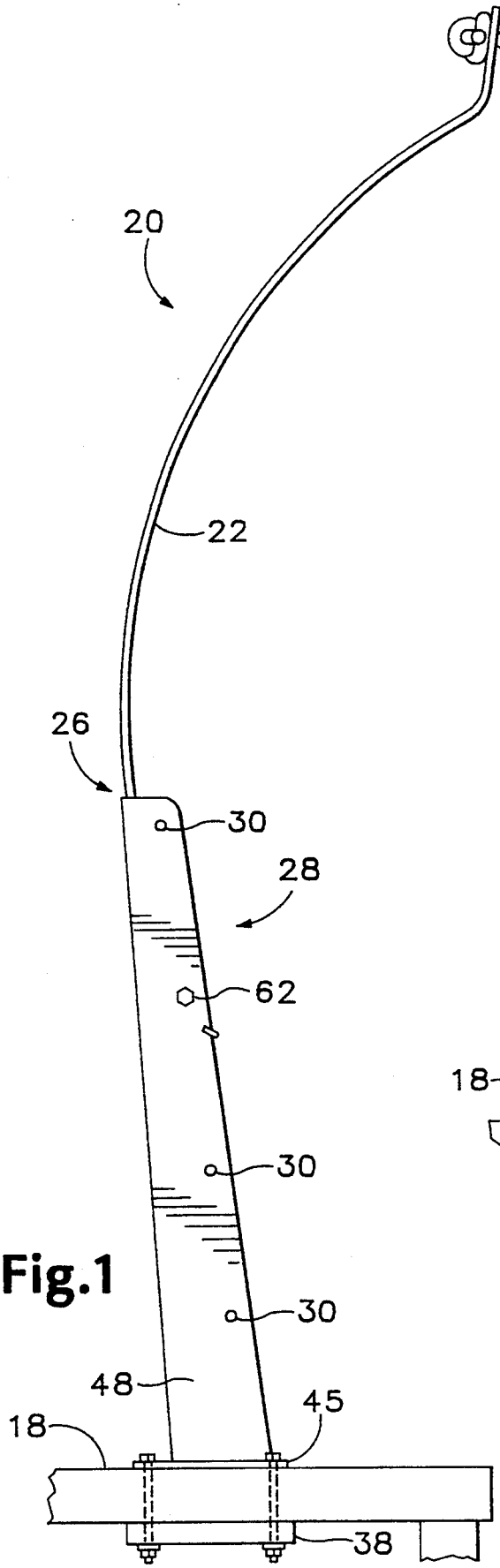
FIG. 1 is a side view of an exemplary embodiment of the present invention including a base having multiple attachment positions.

An exemplary embodiment of a mooring device, indicated generally as 20, for connecting a floating object 16 (FIG. 5) to a moorage structure 18 comprises, as shown in FIG. 1, an elongate resiliently yieldable member 22 attached to a base 28 which is adapted for affixing to a moorage structure 18. One end 24 of the yieldable member 22 is preferably adapted to be removably connected to a floating object 16 and the other end 26 of the yieldable member 22 is pivotally attached to the base 28.

Figure 6:
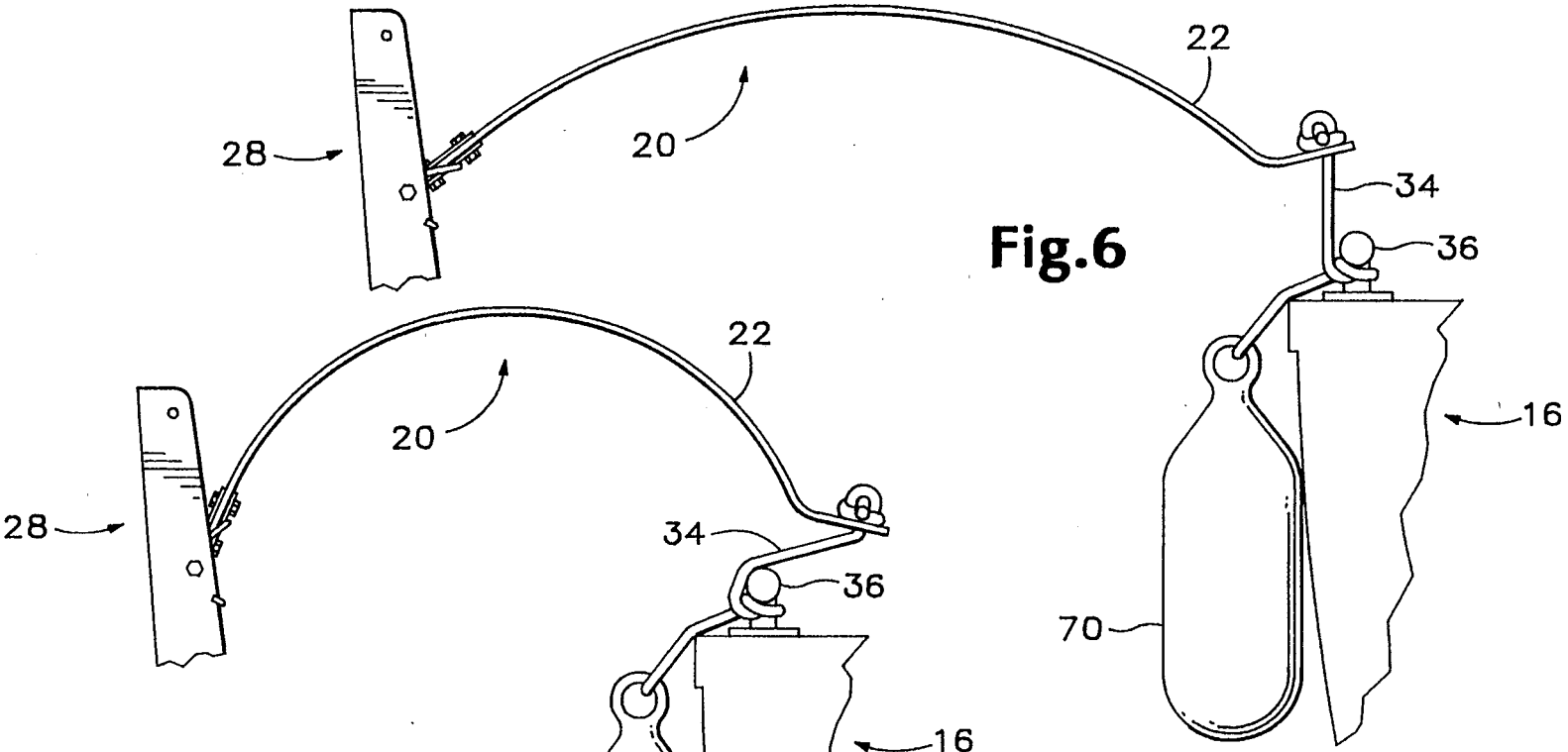
FIG. 6 is a side view of the embodiment of FIG. 1 in an unstressed state.
Figure 7:
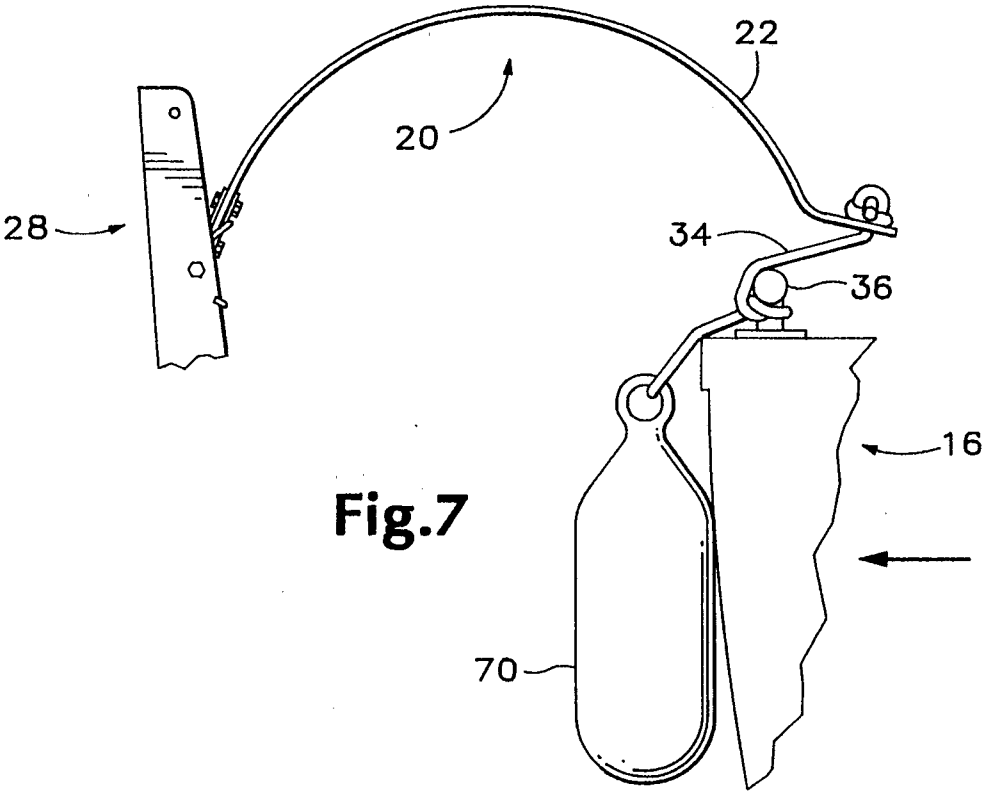
FIG. 7 is a side view of the embodiment of FIG. 1 in a stressed state.

More specifically, FIG. 1 shows an exemplary embodiment of the present invention 20 including an elongate resiliently yieldable member 22 which has a longitudinally-extending, normally arcuate shape when in an unstressed state, as shown also in FIG. 6. The yieldable member 22 is capable of providing an unusually stiff yieldable resistance to movement of the floating object 16 toward the moorage structure 18 by bending from the normally arcuate shape in the unstressed state (FIG. 6) to a slightly more arcuate shape in a stressed state as shown in FIG. 7. The yieldable member 22 in this embodiment may be a fiberglass leaf spring which has an approximate width of 3 inches, an approximate base-to-tip linear dimension of 34 inches, and an approximate average unstressed radius of curvature of 24 inches. The thickness of the member 22 may vary from about 0.30 inch in the areas adjacent its two ends to about 0.35 inch in its central area. It should be noted that other materials such as metals or plastics may be used to form the member 22, and that the dimensions given are meant to be exemplary and could be modified for reasons including the use of different materials and varying sizes of floating object 16.

Figure 3:
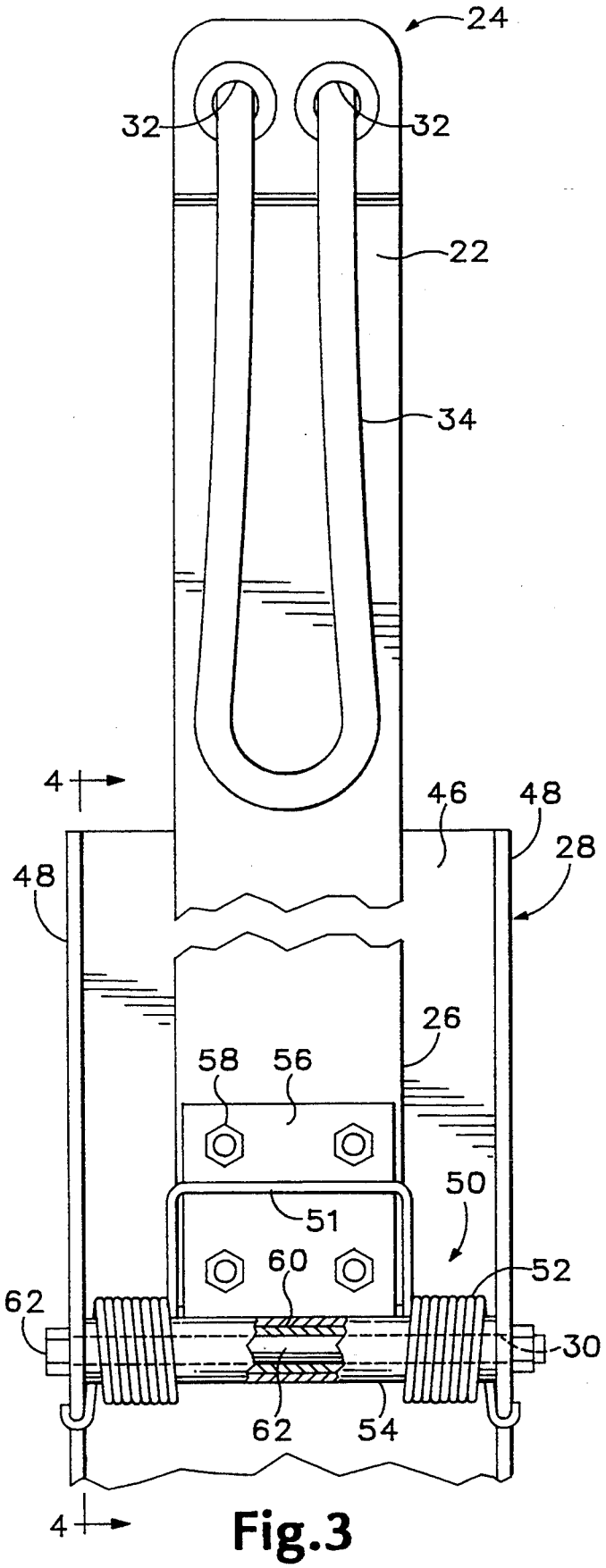
FIG. 3 is a partial front view of the embodiment of FIG. 1.
Figure 5:
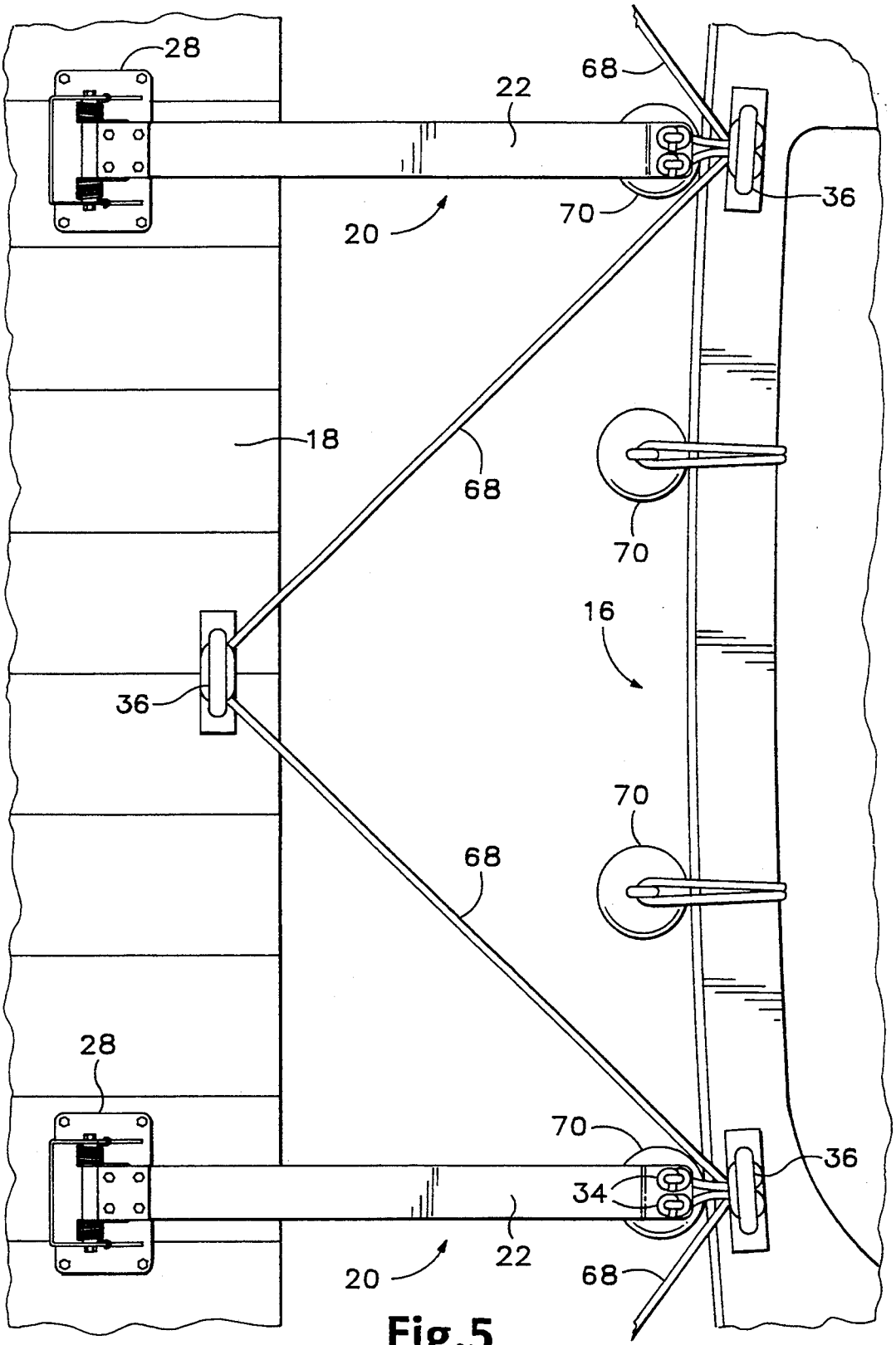
FIG. 5 is a top view showing a pair of mooring devices in accordance with the embodiment of FIG. 1 connecting a floating object to a moorage structure.

Referring again to FIG. 1, the member 22 has an end 24 adapted to be removably connected to the floating object 16. In the preferred embodiment, the end 24 would have two bores 32 defined therein (as shown in FIG. 3) through which a mooring line 34 or rope may be threaded. The ends of the mooring line 34 may be individually knotted, as shown in FIG. 5, or tied together. The effective length of the mooring line 34 may be adjusted by changing the positions of the knots. The loop formed by the mooring line 34 may be attached to a cleat 36 commonly found on floating objects 16 such as boats. Alternate embodiments of the end 24 may also be used, including alternate attachment devices. For example, the end 24 may include a metal hook or clasp which may attach to the cleat 36.

The end 26 of the yieldable member 22 opposite the end 24 is attached to a base 28 which is preferably adapted for affixing to a moorage structure 18. The base 28 may be attached directly to the moorage structure 18 by bolting the base 28 thereto. If desired, a backing plate such as an additional piece of wood or metal 38, which is long enough to span several planks of the moorage structure, can be used for added strength. Another alternate method of attaching the base 28 to the moorage structure 18 would be to through bolt the base 28 to a bull rail 40 (FIG. 2) which is attached to and commonly found on moorage structures 28.

Figure 2:
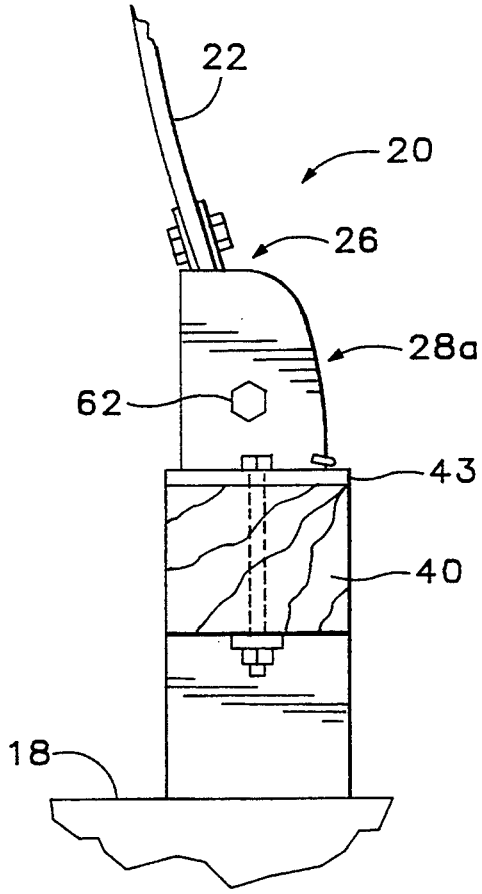
FIG. 2 is a side view of an exemplary embodiment of a base of the present invention having a single attachment position.
Figure 4:
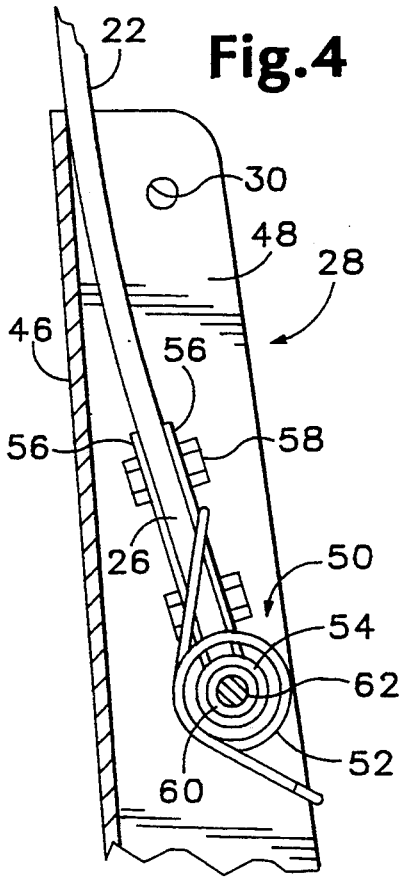
FIG. 4 is a partial sectional side view taken along line 4—4 of FIG. 3.

In the embodiments shown in FIGS. 1 and 2, the bases 28 and **28*a* each have a back such as 46 and two sides such as 48 which are attached along the longitudinal edges of the back 46 as shown with respect to base 28 in FIGS. 3 and 4. The base may be a single height base 28*a*, such as the embodiment shown in FIG. 2, which includes only one attachment position for the end 26 of the leaf spring 22 consisting of a set of bores (not shown) on either side of the base 42 through which a bolt 62 passes. This embodiment is preferably used when the expected difference in height between the mounted end 26 of the member 22 and the cleat 36 on the floating object 16 is small, i.e., no more than approximately 6 inches. The base may alternatively be a multiple height base 28 as shown in FIG. 1 which includes multiple attachment positions at different heights for selective attachment of the end 26 of the yieldable member 22 to the base 28 at different heights approximately equal to the height of the cleat 36 on the particular floating object 16. Each attachment position preferably includes a set of bores 30 on either side of the base 28 through which a bolt 62 may pass. This embodiment is preferably used when the difference in height between the mounted base 28 and the cleat 36 on the floating object 16 will vary, such as when different floating objects 16** are to be accommodated.

FIGS. 3 and 4 show the pivotal attachment of the end 26 of the yieldable member 22 to the base 28 of FIG. 1. The end 26 is pivotally attached to the base 28 by a pivoted biasing device 50 that enables the yieldable member 22 to be pivoted upwardly from the moorage structure 18 with the aid of the biasing device 50 when the end 24 is free of the floating object 16, and pivoted downwardly in opposition to the biasing device 50 to allow the end 24 to connect to the floating object 16 without requiring any bending of the yieldable member 22 from its normally arcuate shape. The pivoted biasing device 50 preferably includes an upwardly-biasing spring 52 such as a return spring which is less resistant to bending than the yieldable member 22 and which enables said member to be pivoted downwardly without bending from its normally arcuate shape while imposing an upward pressure on the end 24. The end 26 is preferably connected to a metal tube or sleeve 54 preferably having a length greater than the width of the yieldable member 22. The end 26 may be connected to the tube 54 using metal plates 56 on either side of the end 26 which are welded to the tube 54 and bolted to the end 26 using bolts 58. An optional bushing 60 may be inserted through the tube 54 to prevent excess wear as the tube pivots about the bolt 62. This configuration allows the spring 52 to tighten as the yieldable member 22 is lowered, thus providing an upward pressure on the end 24 of the yieldable member 22 (as shown in FIGS. 6 and 7). This upward pressure keeps the mooring line 34 from unfastening from the cleat 36 and also keeps the end 24 of the member 22 from striking the cleat on the floating object 16 as the floating object moves toward and away from the moorage structure.

FIG. 5 shows a floating object 16 attached to a moorage structure 18 using mooring devices 20 which include bases 28. Spring lines 68 may be included to keep the floating object 16 from moving forward or aft to relieve undue stress on the mooring devices 20. Additional bumpers or fenders 70 may also be used for extra protection of the floating object 16.

Figure 8:
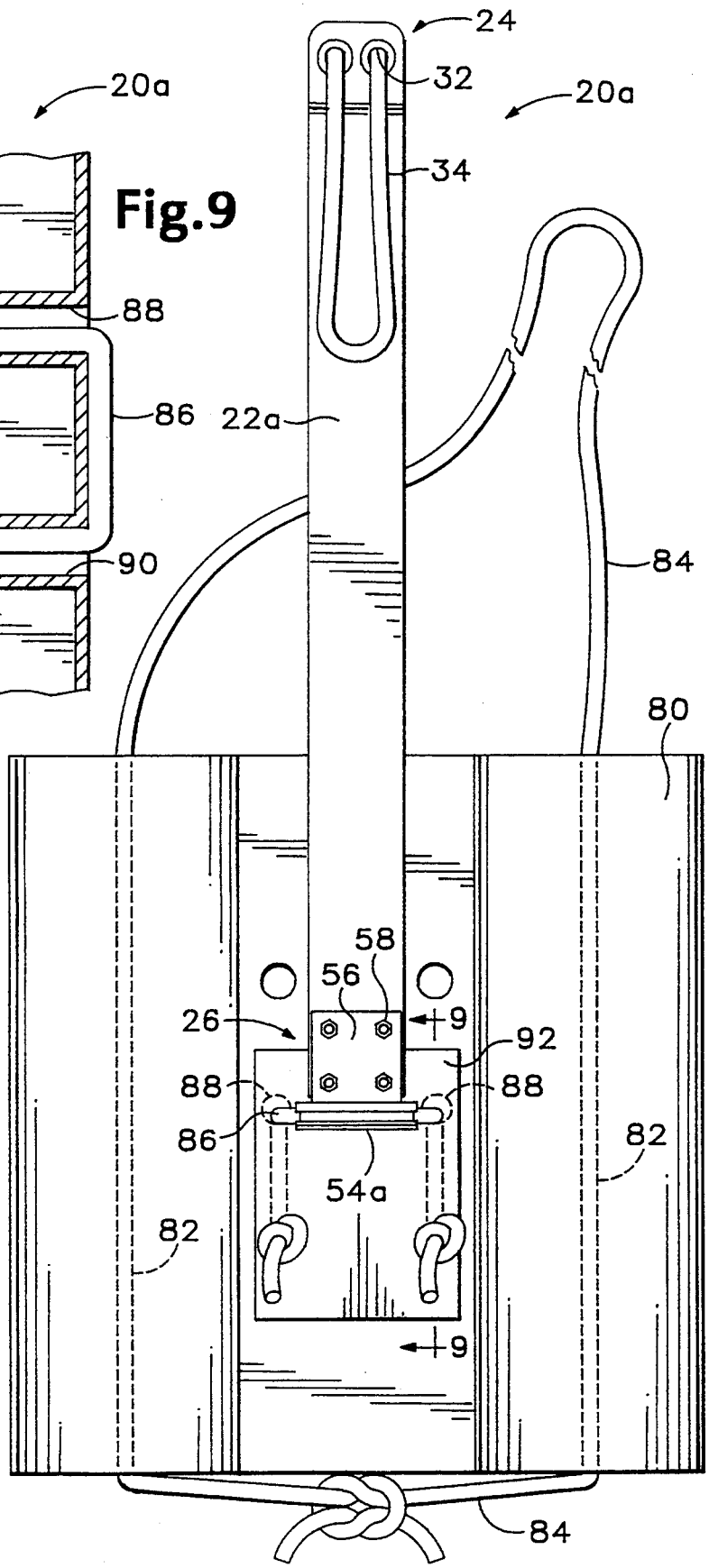
FIG. 8 is a front view of a portable exemplary embodiment of the present invention including a fender for detachably mounting to a floating object.
Figure 10:
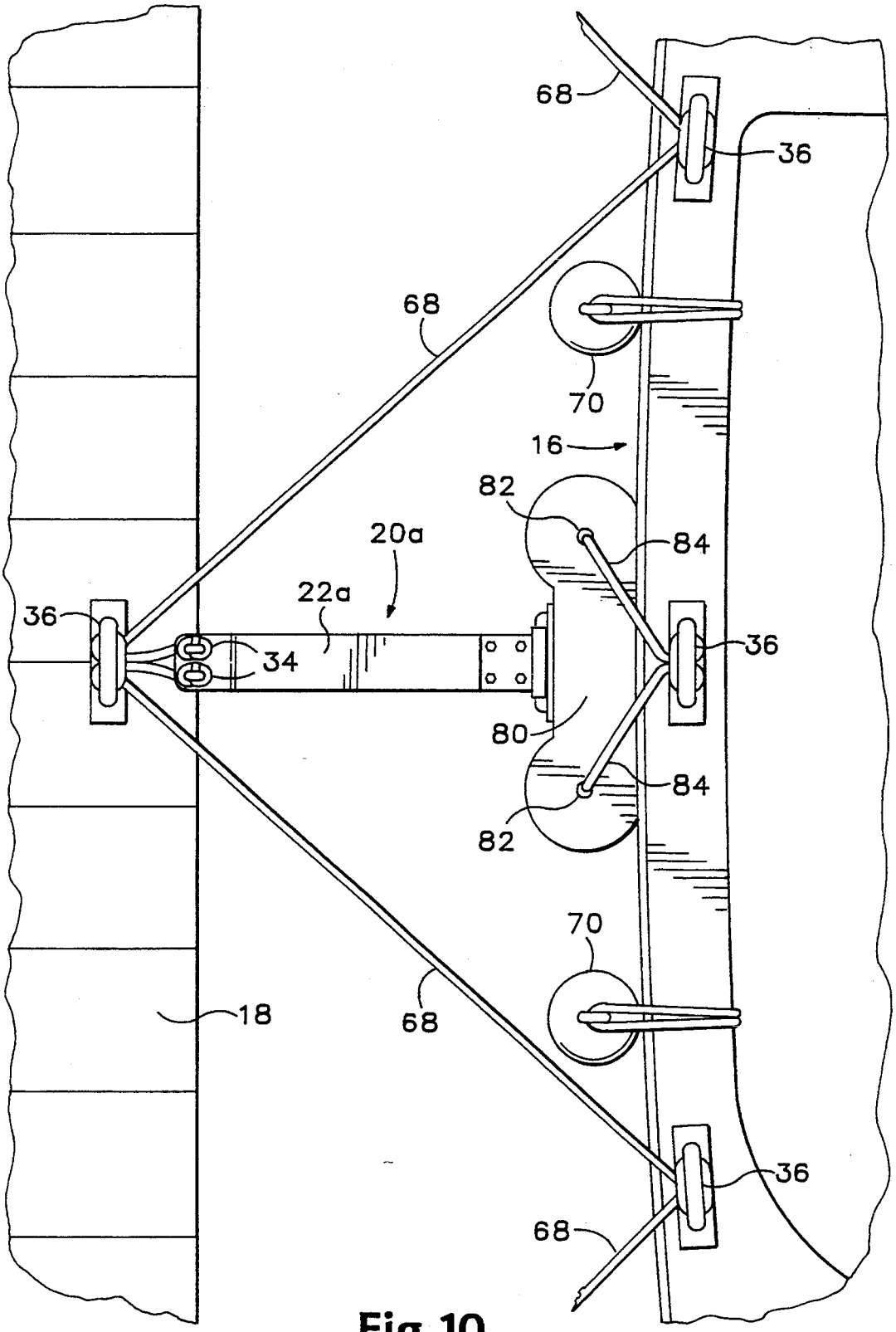
FIG. 10 is a top view of the exemplary embodiment of FIG. 8 shown attached to a floating object using a fender, and connecting the floating object to a moorage structure.
Figure 11:
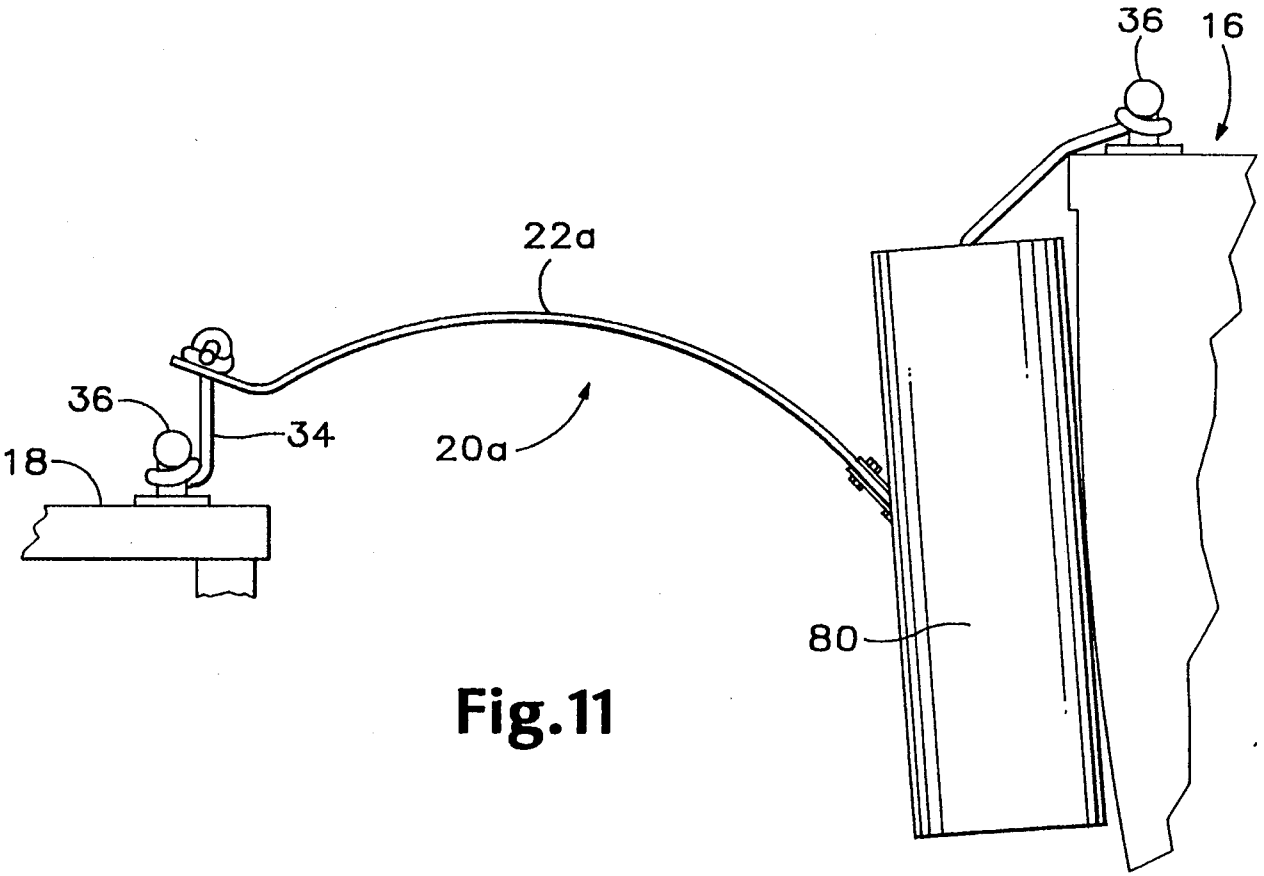
FIG. 11 is a side view of the embodiment of FIG. 8 in an unstressed state.

FIG. 8 shows an alternate exemplary portable embodiment 20a of the mooring device including a fender 80, for connecting a floating object 16 (FIG. 10) to a moorage structure 18 (FIG. 10). The alternate embodiment 20a comprises, as shown in FIG. 8, an elongate resiliently yieldable member 22a, an end 24 adapted to be removably connected to the moorage structure 18, and an end 26 attached to a fender 80 which is adapted to be removably attached to the floating object 16. Like the embodiment discussed above, the elongate resiliently yieldable member 22a has a longitudinally-extending, normally arcuate shape when in an unstressed state (FIG. 11). The yieldable member 22a functions like the previously described member 22 to provide yieldable resistance to movement of the floating object 16 toward the moorage structure 18, and may be a fiberglass leaf spring having the same dimensions as member 22. Preferably, however, the member 22a is somewhat shorter and thinner than the member 22, having an approximate linear base-to-tip dimension of 28 inches, an end thickness of about 0.24 inch, and a central thickness of about 0.27 inch. The radius of curvature and width are approximately the same as described previously.

The fender 80 may be made of any resilient, water-impermeable material such as a flexible plastic, rubber, or closed-cell foam, and is preferably of the type shown in U.S. Pat. No. 5,013,272 which is hereby incorporated by reference. Alternatively, other structures such as a bracket which may be removably secured to the floating object 16 could be used to attach the yieldable member 22a to the floating object and prevent the end 26 from coming in contact with and damaging the floating object 16.

Referring again to FIG. 8, the alternate portable embodiment 20a of the mooring device has an end 24 with a mooring line 34 similar to that of the previous embodiment 20 but, in this case, adapted to be removably connected to the moorage structure 18 rather than the floating object 16. The end 26 opposite the end 24 is attached to the fender 80 which is adapted to be removably attached to the floating object 16 at different heights so that the end 26 of the member 22a is at approximately the same height as a cleat 36 on the moorage structure.

The resilient fender 80 has two longitudinal channels 82 through which a mooring line 84 or rope may be threaded. The ends of the mooring line 84 may be tied together as shown in FIG. 8 or individually knotted. The mooring line 84 is length-adjustable by adjustment of the knot or knots to change the height of the fender 80. The center section of the mooring line 84 forms a loop which may be attached to a cleat 36 commonly found on floating objects 16 such as boats (FIG. 10).

Figure 9:
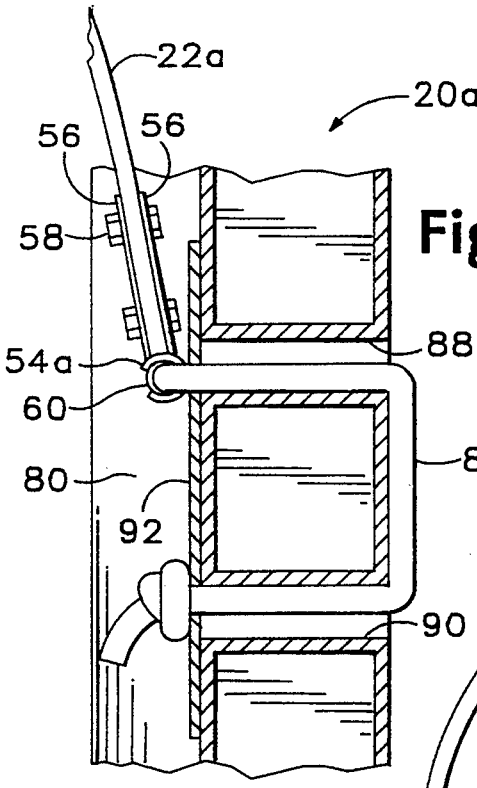
FIG. 9 is a partial sectional view taken along line 9—9 of FIG. 8.

FIGS. 8 and 9 show the attachment of the end 26 of the yieldable member 22a to the fender 80. The end 26 has a metal tube or sleeve 54a similar to tube 54 of the previous embodiment. An optional bushing 60 may be inserted through the tube 54a to prevent excess wear and chafing of a rope 86 which is used to pivotally connect the end 26 to the fender 80. As best seen in FIG. 9, the center portion of the rope 86 is threaded through the tube 54a and the bushing 60, and then through a first set of channels 88 which extend through the thickness of the fender 80. The rope 86 then wraps around the back of the fender 80 and threads back through a second set of channels 90. The ends of the mooring line 86 may be individually knotted or may be tied together. Additional reinforcement 92 such as a plastic or metal plate may be added to the fender 80 to prevent the fender 80 from tearing or abrading.

An additional feature which may be included in the portable embodiment 20a is that the yieldable member 22a may be detachable from the fender 80 for easy storage on the floating object 16. This feature, as shown in FIG. 9, comprises a slot 55 having the width of the rope 86 cut along the entire length of the tube 54a. The slot is located approximately 90° from the end 26 of the yieldable member 22a on the concave side of the member 22a. For detachment from the rope 86, the member 22a may be rotated approximately 180° downward so that the slot 55 faces the fender and is aligned with the rope 86. The tube 54a may then be slid off the rope 86, and the fender 80 and member 22a can be stored separately.

FIG. 10 shows a floating object 16 attached to a moorage structure 18 using the portable alternate embodiment 20a of the mooring device. Spring lines 68 may be included to keep the floating object 16 from moving forward or aft to relieve undue stress from the mooring device 20a. Additional bumpers or fenders 70 may also be used for extra protection of the floating object 16.

It should be noted that the first exemplary embodiment could be adapted so that the base 28 attaches directly to a floating object 16 and the end 24 of the yieldable member 22 could then attach to a cleat 36 on a moorage structure 18. It should also be noted that, in the alternate portable exemplary embodiment, the fender 80 could be adapted to be attached to a cleat 36 on a moorage structure 18 and the end 24 of the yieldable member 22a could attached to a cleat 36 on a floating object 16.

It should also be noted that the embodiments shown in FIGS. 5 and 10 may be used independently and do not necessarily need mooring lines 68 and fenders 70.

Finally, since the mooring device is intended to be used near water in varying climates, the materials used to construct the mooring device 20 are preferably weather resistant and otherwise sturdy.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A mooring device for connecting a floating object to a moorage structure, said mooring device comprising:

(a) an elongate resiliently yieldable member having a first end and a second end;

(b) said first end being attached to a resilient fender which is adapted to be removably attached to said floating object between said member and said floating object;

(c) said second end being adapted to be removably connected to said moorage structure;

(d) said member being capable of providing yieldable resistance to movement of said floating object toward said moorage structure.

2. The apparatus of claim 1 wherein said member has a longitudinally-extending, normally arcuate shape when in an unstressed state, said member being capable of providing said yieldable resistance by bending from said normally arcuate shape to a more arcuate shape.

3. The apparatus of claim 2 wherein said member has a generally flat shape with a breadth substantially greater than its thickness.

4. The apparatus of claim 1 wherein said fender is adapted to be removably suspended from the side of said floating object.

5. The apparatus of claim 1 wherein said second end has a plurality of bores defined for receiving a loop of mooring line for linking said second end to said moorage structure.

6. The apparatus of claim 1 wherein said first end is pivotally attached to said fender.

7. A mooring device connecting a floating object to a moorage structure, said mooring device comprising:

(a) an elongate resiliently yieldable member having a first end and a second end and having a longitudinally-extending, normally arcuate shape when in an unstressed state, said member being operatively connected between said floating object at said first end and said moorage structure at said second end;

(b) said member being yieldably bendable from said normally arcuate shape to a more arcuate shape in response to movement of said floating object toward said moorage structure so as to yieldably resist said movement; and (c) said first end being mounted on a base attached to a resilient fender which is removably attached to said floating object between said member and said floating object, and said second end being detachably connected to said moorage structure.

8. A mooring device for connecting a floating object to a moorage structure, said mooring device comprising:

(a) an elongate resiliently yieldable member having a longitudinally-extending, normally arcuate shape when in an unstressed state, said member having a first end and a second end;

(b) said first end being adapted to be removably connected to said floating object;

(c) said second end being pivotally attached to a base, which is adapted for affixing to said moorage structure, by a pivotal biasing device that enables said member to be pivoted upwardly from said moorage structure with the aid of said biasing device when said first end is free of said floating object and pivoted downwardly in opposition to said biasing device to allow said first end to connect to said floating object without requiring any bending of said member from said normally arcuate shape;

(d) said member being capable of providing yieldable resistance to movement of said floating object toward said moorage structure by bending from said normally arcuate shape to a more arcuate shape; and (e) said first end having a plurality of bores defined therein for receiving a loop of mooring line for linking said first end to said floating object.

9. A mooring device for connecting a floating object to a moorage structure, said mooring device comprising:

(a) an elongate resiliently yieldable member having a longitudinally-extending, normally arcuate shape when in an unstressed state, said member having a first end and a second end;

(b) said first end being adapted to be removably connected to said floating object;

(c) said second end being pivotally attached to a base, which is adapted for affixing to said moorage structure, by a pivotal biasing device that enables said member to be pivoted upwardly from said moorage structure with the aid of said biasing device when said first end is free of said floating object and pivoted downwardly in opposition to said biasing device to allow said first end to connect to said floating object without requiring any bending of said member from said normally arcuate shape;

(d) said member being capable of providing yieldable resistance to movement of said floating object toward said moorage structure by bending from said normally arcuate shape to a more arcuate shape; and (e) said base including multiple attachment positions at different heights for selective attachment of said second end to said base at said different heights.

* * * * *